US008746255B2

(12) United States Patent
Hasegawa et al.

(10) Patent No.: US 8,746,255 B2
(45) Date of Patent: Jun. 10, 2014

(54) CIGARETTE FILTER

(75) Inventors: Takashi Hasegawa, Tokyo (JP); Hiroyuki Torai, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 161 days.

(21) Appl. No.: 13/161,635

(22) Filed: Jun. 16, 2011

(65) Prior Publication Data

US 2011/0240046 A1 Oct. 6, 2011

Related U.S. Application Data

(63) Continuation of application No. PCT/JP2010/050064, filed on Jan. 6, 2010.

(30) Foreign Application Priority Data

Jan. 8, 2009 (JP) ..... 2009-002871

(51) Int. Cl.
*A24D 3/04* (2006.01)

(52) U.S. Cl.
USPC ..... 131/335; 131/331; 131/332

(58) Field of Classification Search
CPC .. A24D 3/0216; A24D 3/0212; A24D 3/0225
USPC ..... 131/335, 331, 332
See application file for complete search history.

(56) References Cited

U.S. PATENT DOCUMENTS

| | | | | |
|---|---|---|---|---|
| 4,038,992 | A * | 8/1977 | Ogasa et al. | 131/342 |
| 4,889,144 | A | 12/1989 | Tateno et al. | |
| 4,917,121 | A | 4/1990 | Riehl et al. | |
| 5,144,964 | A | 9/1992 | Demain | |
| 5,479,949 | A | 1/1996 | Battard et al. | |
| 2003/0159703 | A1* | 8/2003 | Yang et al. | 131/335 |
| 2006/0021624 | A1 | 2/2006 | Gonterman et al. | |
| 2007/0000505 | A1* | 1/2007 | Zhuang et al. | 131/342 |
| 2007/0261706 | A1 | 11/2007 | Banerjea et al. | |
| 2007/0267033 | A1* | 11/2007 | Mishra et al. | 131/275 |
| 2008/0142028 | A1 | 6/2008 | Fagg | |

FOREIGN PATENT DOCUMENTS

| | | | |
|---|---|---|---|
| CN | 1988815 | A | 6/2007 |
| CN | 101094597 | A | 12/2007 |
| CN | 101199363 | A | 6/2008 |
| JP | 5-146285 | A | 6/1993 |
| JP | 7-504080 | A | 5/1995 |
| JP | 2709077 | B2 | 10/1997 |
| JP | 10-279986 | A | 10/1998 |
| JP | 2007-319041 | A | 12/2007 |
| JP | 2008-48650 | A | 3/2008 |
| JP | 2008-507972 | A | 3/2008 |
| JP | 2008-523800 | A | 7/2008 |
| KP | 1991-0000142 | B1 | 1/1991 |
| TW | 200848505 | A | 12/2008 |
| WO | WO 03/059096 | A1 | 7/2003 |
| WO | WO 2006/090290 | A1 | 8/2006 |
| WO | WO 2007-104908 | A1 | 9/2007 |
| WO | 2008/067021 | A2 | 6/2008 |
| WO | WO 2008/072627 | A1 | 6/2008 |

OTHER PUBLICATIONS

International Search Report issued in PCT/JP2010/050064, mailed Apr. 13, 2010.

First Office Action issued Nov. 13, 2012, in Japanese Patent Application No. 2010-545771, with English translation.

Japanese Office Action dated Jun. 4, 2013 for Application No. 2010-545771 with Translation.

Chinese Office Action for corresponding Application No. 201080004128.5 dated Mar. 1, 2013 (with English translation).

International Preliminary Report on Patentability and English translation of the Written Opinion of the International Searching Authority for corresponding Application No. PCT/JP2010/050064 dated Aug. 25, 2011 (Forms PCT/IB/338, PCT/IB/373, and PCT/ISA/237).

Notification for Filing Opinion issued Jan. 24, 2013, in Korean Patent Application No. 10-2011-7013787, with English translation.

Office Action dated Sep. 2, 2013 for Chinese Patent Application No. 2010800041285 with English Translation.

Euorpean Search Report dated Jan. 16, 2014 for Application No. 10729218.

* cited by examiner

*Primary Examiner* — Joseph S Del Sole
*Assistant Examiner* — Dionne Walls Mayes
(74) *Attorney, Agent, or Firm* — Birch, Stewart, Kolasch & Birch, LLP

(57) ABSTRACT

A cigarette filter includes a filter body and flavor granules added to the filter body, wherein the flavor granules each comprise a core material and a flavor-carrying carrier adhered to the surface of the core material, and wherein the flavor granules have a grain size distribution such that granules having a grain size of 100 μm or larger make up 99% by mass or more of the flavor granules and granules having a grain size of 200 μm or larger make up 70% by mass or more of the flavor granules.

12 Claims, 2 Drawing Sheets

CIGARETTE FILTER

CROSS REFERENCE TO RELATED APPLICATIONS

This is a Continuation Application of PCT Application No. PCT/JP2010/050064, filed Jan. 6, 2010, which was published under PCT Article 21(2) in Japanese.

This application is based upon and claims the benefit of priority from prior Japanese Patent Application No. 2009-002871, filed Jan. 8, 2009, the entire contents of which are incorporated herein by reference.

BACKGROUND OF THE INVENTION

1. Field of the Invention

The present invention relates to a cigarette filter to which flavor granules each comprising a core material having a flavor-carrying carrier on the surface have been added.

2. Description of the Related Art

In order to improve smoking flavor of cigarettes, various flavors have been added to cigarettes. However, when a flavor is merely added to a cigarette, the flavor is evaporated during a storage period from production of the cigarette to actual smoking, and as a result, there is a tendency that the flavor cannot be released sufficiently into mainstream smoke on smoking after storage. In order to solve this problem, for example, Patent Document 1 (Jpn. Pat. Appln. KOKAI Publication No. 5-146285) describes that a complex in which a lipophilic organic flavor is enclosed in a β-cyclodextrin derivative is added to a tobacco filler or a cigarette paper. Furthermore, Patent Document 2 (Jpn. PCT National Publication No. 7-504080) describes that an aromatic substance enclosed in cyclodextrin is added to a cigarette paper.

Meanwhile, addition of charcoal to a cigarette filter is one of effective means for removing substances that are desired to be removed from mainstream smoke. However, there is a problem that smoking flavor of cigarette mainstream smoke is diluted by addition of charcoal to a filter. In connection with this problem, such dilution of smoking flavor due to addition of charcoal can also be suppressed by enclosing a flavor in cyclodextrin as mentioned above.

On the other hand, when a flavor is added to a tobacco filler or a cigarette paper as in Patent Documents 1 and 2, the flavor is also burned during the burning of cigarette, and thus desired smoking flavor may not be obtained. In view of this problem, it is suggested that a flavor is added to a cigarette filter rather than tobacco shreds or the like. For example, Patent Document 3 (Jpn. Pat. Appln. KOKAI Publication No. 10-279986) describes that a fine powder is prepared by enclosing a lipophilic flavor substance in a branched α-cyclodextrin and it is added to a filter in various forms.

However, when a flavor is added to a filter in the form of a fine powder, it has problems that the fine powder cannot be added uniformly by any means and is unevenly distributed, and that the fine powder drops out of the filter. Furthermore, there is a fear that the air-flow resistance of the filter is increased by adding the powder, as compared to that of an existing product, and it causes a trouble during smoking. In addition, the fine powder may enter the mouth, which is not preferable. Special additional facilities are required in order to obtain such a filter having a special form as in Patent Document 3.

BRIEF SUMMARY OF THE INVENTION

It is an object of the present invention to provide a cigarette filter characterized by that flavor can be sufficiently released into mainstream smoke during smoking without evaporating a flavor during a storage period, that the filter can be used in combination with charcoal (active carbon), and that a flavor can be added uniformly to the filter and the air-flow resistance is not increased as compared to that of an existing product even when the flavor is added.

The present invention provides a cigarette filter comprising a filter body and flavor granules added to the filter body, wherein the flavor granules each comprise a core material and a flavor-carrying carrier adhered to the surface of the core material, and wherein the flavor granules have a grain size distribution such that granules having a grain size of 100 μm or larger make up 99% by mass or more of the flavor granules and granules having a grain size of 200 μm or larger make up 70% by mass or more of the flavor granules.

According to the present invention, the above-mentioned problems can be solved by means of flavor granules added to a filter, wherein the flavor granules each comprise a core material and a flavor-carrying carrier adhered to the surface of the core material, and wherein the flavor granules have a grain size distribution such that granules having a grain size of 100 μm or larger make up 99% by mass or more of the flavor granules and granules having a grain size of 200 μm or larger make up 70% by mass or more of the flavor granules.

Since the grain size of the flavor granules is approximately the same as the grain size of charcoal that is used for a charcoal filter, the flavor granules can be added uniformly to the filter in a similar manner to addition of charcoal by means of existing facilities. Furthermore, since the grain size of the flavor granules is approximately the same as that of charcoal, the air-flow resistance during smoking is approximately the same as that of a general cigarette filter. Since the flavor is carried on the flavor carrier, evaporation of the flavor during a storage period can be suppressed, and also adsorption of the flavor on charcoal can be suppressed.

DETAILED DESCRIPTION OF THE INVENTION

Figure 1:
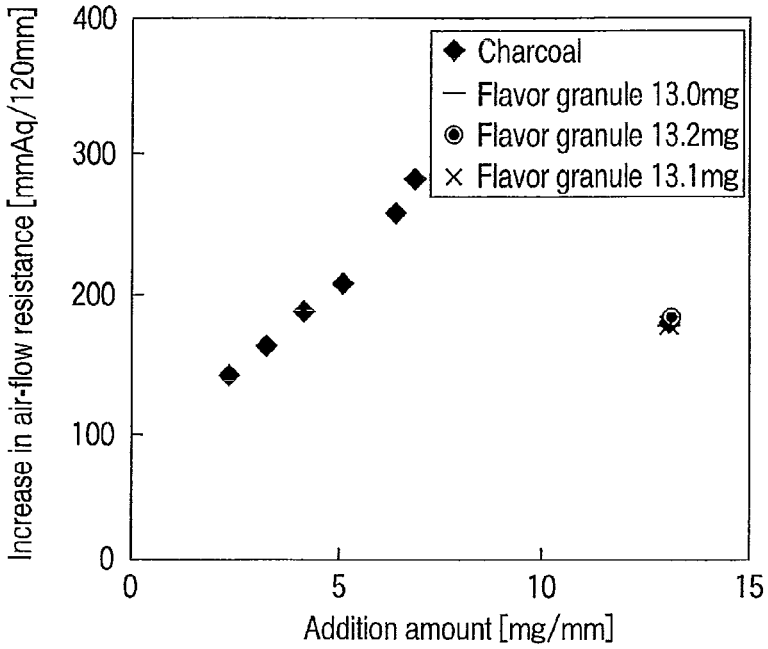
FIG. 1 is a graph showing the measurement results of the air-flow resistance of a filter.

The present invention will now be described in more detail.

In the cigarette filter of the present invention, flavor granules are added to a filter body, wherein each of the flavor granules comprises a core material having a flavor-carrying carrier on the surface.

The filter body is one generally used for a cigarette, and is connected to tobacco shreds that is rolled up in a cigarette paper, by a tipping paper. Specific examples include a cellulose acetate filter, a paper filter and the like.

The flavor granules have such a grain size distribution (based on a mass of a dry-sieved grain size obtained by the dry sieving test according to JIS K 0069 (1992)) that granules having a grain size of 100 μm or larger make up 99% by mass or more of the flavor granules and granules having a grain size of 200 μm or larger make up 70% by mass or more of the flavor granules. Generally, the grain size is 1,500 μm at the maximum, and the average grain size is from 500 to 600 μm.

The dry sieving test uses a sieve according to the JIS Z 8801 Standard. The grain size of the flavor granules is approximately the same as the grain size of charcoal that is added to a charcoal filter. Therefore, the flavor granules to be added to the cigarette filter of the present invention can be added uniformly to the filter body in a similar manner to addition of charcoal by means of a general apparatus for adding charcoal to a cigarette.

In a cigarette having the filter of the present invention to which the flavor granules have been added, air-flow resistance may be in the range of 200 to 800 mmAq/120 mm. When a powder and the like are added to a filter, there is a fear that the air-flow resistance of the filter is increased, and it causes a trouble during smoking. However, since the flavor granules used for the cigarette filter of the present invention have an approximately the same size as that of charcoal, they hardly change air-flow resistance (that is, the filter shows an air-flow resistance similar to that of a charcoal filter). This is important in smoking a cigarette.

The flavor granules to be added to the cigarette filter of the present invention preferably have an average hardness of 300 $g/mm^2$ or more. When the average hardness of the flavor granules is lower than 300 $g/mm^2$, it is not preferable since the granules become fragile.

The cigarette filter of the present invention has a full length in the range of, for example, 15 to 40 mm, and a diameter in the range of, for example, 5 to 8 mm. The filter can be divided into a plurality of segments, for example, a segment comprising flavor granules, a segment comprising charcoal, and the like. Here, a segment comprising the flavor granules described above may be in the range of, for example, 5 to 35 mm.

The flavor granules can be added to the filter in the range of 1 to 20 mg per mm of filter length. When the flavor granules are less than 1 mg, the flavor granules tend to not be able to emit fragrance sufficiently into mainstream smoke of the cigarette. Even when the flavor granules are added by greater than 20 mg, the fragrance emitted into mainstream smoke is not so much changed.

As mentioned above, the flavor granules comprise core material granules having a flavor-carrying carrier on the surfaces thereof.

The core material is used for adjusting the grain size of the flavor granules to a desired range. The average grain size of the core material is generally from 100 to 900 μm. As the core material, a saccharide/polysaccharide or a porous body, or a combination of two or more kinds selected from the saccharide/polysaccharide and the porous body can be used. As the saccharide/polysaccharide, for example, starch can be used. As the porous body, charcoal and/or zeolite can be used. By using charcoal as the core material, fragrance is emitted by the flavor granules on the surface of the core material, and at the same time the charcoal can adsorb substances that are desired to be removed from mainstream smoke.

The amount of the carrier is preferably 1.0 or less by weight ratio with respect to the core material. When the amount of the carrier is more than 1.0 by weight ratio with respect to the core material, it is not preferable since the amount of the unadhered carrier tends to increase in the step of the preparation of granules. It is more preferable that the amount of the carrier is in the range of 0.001 to 0.5 by weight ratio with respect to the core material.

As the carrier, any carrier can be used as long as it can carry a flavor, and for example, cyclodextrin can be used. When cyclodextrin is used as the carrier, so-called an inclusion complex in which the flavor is enclosed is formed. The inclusion complex can be obtained by mixing cyclodextrin and a flavor in water under stirring, and removing water by evaporation. Cyclodextrin may be either a type α or β, and the polymerization degree thereof is not specifically limited. In general, cyclodextrin is commercially available in the form of a powder, and can also be obtained as an inclusion complex in which a flavor has been already enclosed.

The amount of the flavor is in the range of 0.00003 to 0.15 by weight ratio with respect to the core material. When the amount of the flavor is less than 0.00003 by weight ratio with respect to the core material, it is not preferable since the amount of the released flavor during smoking is decreased significantly. When the amount of the flavor exceeds 0.15, the flavor that has not been enclosed in the flavor carrier is precipitated on the surfaces of the flavor granules, whereby flavor-retention property tends to decrease after that.

As the flavor described above, a lipophilic flavor can be used. Examples of the lipophilic flavor may include, but are not limited to, vanillin, ethylvanillin, gualinaloot, thymol, methyl salicylate, coumarin, linalool, eugenol, l-menthol, clove, anise, cinnamon, bergamot oil, geranium, lemon oil, spearmint and ginger.

The surface of the core material that constitutes the flavor granules of the present invention may comprise a binder so that the flavor-carrying carrier is certainly adhered to the surface of the core material. For example, the core material can be coated with a mixture of the flavor-carrying carrier and the binder.

It is preferable that the binder is added in the range of 0.001 to 0.1 by weight ratio with respect to the core material. As the binder, for example, one or more kinds selected from the group consisting of maltose syrup, pullulan, gum arabic and granulated sugar can be selected.

The cigarette filter of the present invention can be used for, for example, a general cigarette. As mentioned above, the flavor granules used for the cigarette filter of the present invention has the flavor-carrying carrier on the surface of the core material. Therefore, the carrier on the surface of the core material contacts efficiently with smoke that passes through the filter, whereby releases the flavor carried on the carrier. As a result, the smoking flavor of the cigarette can be further improved.

EXAMPLES

The present invention will be described in more detail by way of Examples below.

[Preparation of Flavor Granules]

The flavor granules to be added to the cigarette filter of the present invention were prepared.

60 kg of Nonpareil 101 (registered trademark) (24/32 mesh, manufactured by Freund Corporation, spherical granules composed of saccharose and corn starch) was prepared as a core material. The surface of the core material was coated with a mixture of 10 kg of a β-cyclodextrin powder (manufactured by Pearl Ace Corporation) enclosing 8.4 wt % of l-menthol and 5.6 kg of an aqueous solution containing 36 wt % of maltose syrup (binder). After the coating, the coated core material was dried to obtain flavor granules. For the coating, a centrifugal flow type of granulator (CF-1000) manufactured by Freund Corporation, was used. The revolution number was 100 rpm, and the slit air rate was 1.7 $N \cdot m^3/min$. The spray velocity of the binder solution was 100 g/min (conversion into water), and the spray air rate was 40 N·L/min. The β-cyclodextrin powder enclosing the flavor was fed to the granulator by means of a vibrating feeder. For the drying, a flow drier (NFOD-90) manufactured by Freund Corporation, was used. Humidification was performed at an intake air temperature of 65° C. for 30 minutes, and then cooling was performed at an intake air temperature of 30° C. for 10 minutes. Thereafter, classification was performed at a sieving width of 500 to 1,000 μm to obtain flavor granules. After sieving, the grain sizes of substantially all of the granules other than a trace amount of nonstandard granules produced in the production steps were within the range of the sieving width.

[Evaluation of Hardness, Grain Size and Amounts of Components of Flavor Granules]

The hardness, grain size and components of the flavor granules were evaluated.

Using a hardness measurement apparatus (manufactured by Okada Seiko Co., Ltd., (GRANO)), the average hardness, grain size distribution and average grain size of the flavor granules were measured. As a result, the average hardness of the flavor granules was shown as 490 g/mm$^2$, 99% by mass or more of the flavor granules showed a grain size of from 500 to 1,000 μm, 70% by mass or more showed a grain size of from 540 to 630 μm, and the average grain size was shown as 588 μm.

The β-cyclodextrin in the flavor granules was analyzed by means of high-performance liquid chromatography using ultrapure water as an extraction solvent. On the other hand, l-menthol was analyzed by means of gas chromatography using hexane as an extraction solvent. According to the result as obtained, β-cyclodextrin was 12.7 wt % and l-menthol was 1.2 wt %.

[Preparation of Flavor-Added Filter]

Cigarette filters to which the obtained flavor granules had been added were prepared.

By using an existing filter making machine (manufactured by Sanjo Machine Works, Ltd. (FRAC1)), filter bodies each having length of 120 mm and diameter of 7.8 mm were prepared. For the preparation of the filter bodies, an acetate tow of 8Y29000 was used as a base. A plasticizer triacetin had been added to the filter bodies in amounts of 2, 6 and 12 wt %, respectively, with respect to the acetate tow. In a similar manner to the preparation of existing charcoal-added filters, the acetate tow was opened, the flavor granules were added thereto, and it was formed into a cylindrical shape. The addition amounts of the flavor granules were 13.2, 13.0 and 13.1 mg per mm of filter length, respectively, with respect to the filter bodies that were prepared by the above-mentioned addition amounts of triacetin.

[Measurement of Air-Flow Resistance and Filtration Property of Filter]

The air-flow resistance of the filter sample (length: 120 mm) obtained above was measured by means of a quality test module (QTM) manufactured by Filtrona. In the measurement, the air flow rate was 1,050 mL/min.

Next, test cigarettes were prepared. General tobacco shreds were wrapped with a cigarette paper, and an acetate filter was connected thereto by a tipping paper. The tipping paper has ventilation holes formed thereon. Only the filter part was drawn out from the test cigarette while retaining the cigarette rod and tipping paper as they are, and the filter prepared above was cut into 10, 15 and 20 mm, respectively, and inserted therein.

The ventilation holes of the tipping paper were occluded with a tape, and a smoking test was performed by means of a linear smoking machine (SM400) manufactured by Filtrona. The smoking conditions were an intake smoke volume of 35 mL/puff, a puff time of 2 seconds, an interval between puffs of 58 seconds and a cigarette butt length of 33 mm. The produced smoke was collected by means of a Cambridge filter. The collected components were analyzed by means of gas chromatography to quantify the amount of nicotine in smoke. In addition, a sample having a hollow in the filter portion was prepared by removing a filter from the test cigarette, and the amount of nicotine in smoke was quantified. The ratio of a nicotine amount in the sample comprising the filter described above to a nicotine amount in the sample having a hollow in the filter portion was considered as the nicotine permeability. This is referred to as the filtration property.

FIG. 1 shows the results of the measurements of the air-flow resistance of filter samples that were prepared by the addition amount of triacetin of 2 wt % with respect to acetate tow. The horizontal axis of the graph represents the addition amounts of the flavor granules and charcoal per mm of filter length, and the longitudinal axis represents the difference in air-flow resistance between each of the filter samples and a filter sample to which neither the flavor granules nor charcoal had been added. Namely, the graph shows increase in the air-flow resistance when the flavor granules or charcoal is added to the filter. The group (–), group (x) and group (◎) represents the measurement data for filters that were prepared by adding the above flavor granules in the amount of 13.0, 13.1 and 13.2 mg per mm of filter length, respectively, and they indicate about the same value. The group (black diamond) represents measurement data for test filters that were prepared by adding charcoal in various amounts for comparison.

As is apparent from FIG. 1, increase in the air-flow resistance was almost proportional to the increase in the addition amount of charcoal, whereas in the case where the flavor granules were added, increase in the air-flow resistance was not caused to the extent that the air-flow resistance increases in the case where charcoal was added. Therefore, it was confirmed that the quality of the filter that contributes to the designing of cigarette products can be retained even if the flavor granules were added. In addition, the increase in the air-flow resistance per the addition amount of the flavor granules was lower than that of charcoal. This is considered to be attributed to the fact that the flavor granules have a higher bulk density and a larger average grain size than those of charcoal.

Figure 2:
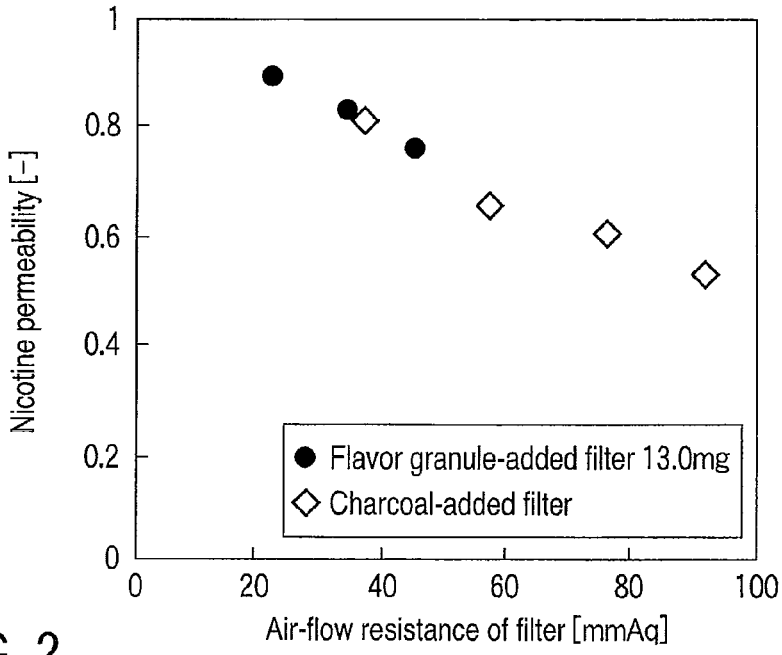
FIG. 2 is a graph showing the filtration properties.

Next, FIG. 2 shows the filtration properties of the filter samples that were prepared by the addition amount of triacetin of 2 wt % with respect to acetate tow. The horizontal axis of the graph in FIG. 2 represents the air-flow resistance of the filter, and the longitudinal axis represents the nicotine permeability. The group (black circles) represents the measurement data for the filter samples that comprise the above flavor granules in the amount of 13.0 mg per mm of filter length and have filter lengths of 10, 15 and 20 mm, respectively, starting from the left in the figure. The group (◇) represents measurement data for the filter samples that comprise charcoal in a constant amount for comparison and have different filter lengths, respectively, that were elongated at a constant rate from the left in the figure.

As is apparent from FIG. 2, in both cases of the flavor granule-added filter and charcoal-added filter, the nicotine permeability was decreased at a constant rate as the filter length was elongated, and the decrease rate was approximately the same in both cases. Also from this result, it is understood that the flavor granule-added filter of the present invention does not cause problems in the designing of actual cigarette products.

[Evaluation of Amount of Flavor Released into Smoke]

Next, the relationship of the addition amount of triacetin with the amount of the flavor released into smoke was evaluated. As mentioned above, triacetin is a filter plasticizer, and also it has flavor-dissolving property and may affect the amount of the released flavor.

Test cigarettes were prepared in a similar manner to that mentioned above.

Filters were prepared in a similar manner to that mentioned above (addition amounts of triacetin: 2 and 6% by weight) and cut into a length of 10 mm. The prepared filter was sandwiched between two acetate filters that were prepared separately, at both ends of the filter (the side of shreds and the side of cigarette end when it is connected to a cigarette), and the thus prepared filter was replaced with the filter of the test cigarette described above.

The ventilation holes of the tipping paper were occluded with a tape, and a smoking test was performed by means of a linear smoking machine (SM400) manufactured by Filtrona. The smoking conditions were an intake smoke volume of 35 mL/puff, a puff time of 2 seconds, an interval between puffs of 58 seconds, and a cigarette butt length of 33 mm. The produced smoke was collected by means of a Cambridge filter. The collected components were analyzed by means of gas chromatography to quantify the amount of l-menthol in smoke. The result is shown in FIG. 3.

Figure 3:
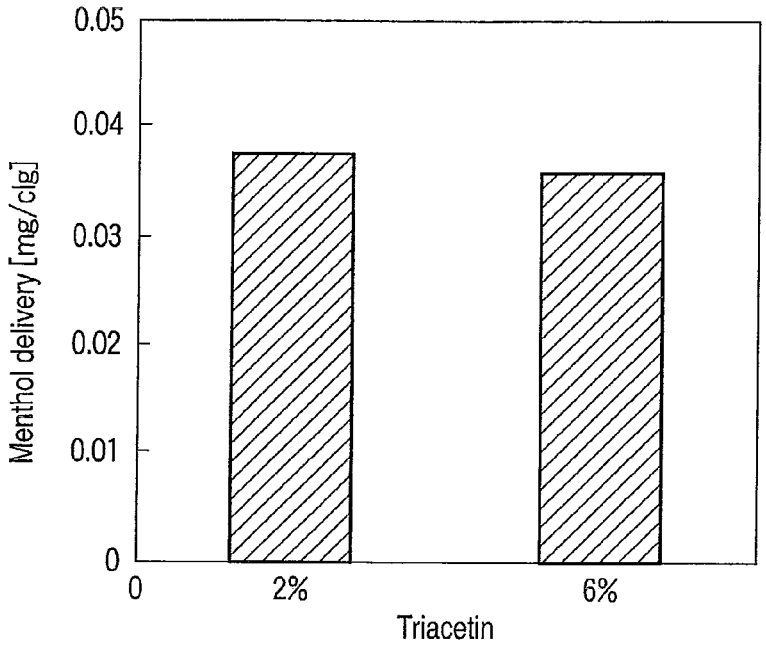
FIG. 3 is a graph showing the amounts of l-menthol in smoke.

As is apparent from FIG. 3, a similar amount of l-menthol in smoke was observed in both of the samples in which the addition amounts of triacetin were 2 and 6 wt %. Namely, it was found that the amount of 1-menthol in the cigarette filter of the present invention was not decreased even when the amount of triacetin was increased.

[Evaluation of Flavor-Retention Property During Storage Period]

Next, the flavor-retention property of the flavor during the storage period was evaluated.

Filters were prepared in a similar manner to that mentioned above (addition amounts of triacetin: 2 and 6% by weight) and cut into a length of 8 mm. The prepared filter was sandwiched between an acetate charcoal filter having a length of 12 mm and an acetate filter having a length of 5 mm that were prepared separately, at the side of the shreds and the side of the cigarette end when connected to a cigarette, respectively. A cigarette was prepared by replacing the thus prepared filter with a filter of commercially available MILD SEVEN Super Lights. As the charcoal for the acetate charcoal filter, the same kind of charcoal as that used for commercial products was used, and the addition amount thereof was 84 mg. A plurality of cigarettes were put into a sealed container and stored under a condition of 22° C. and 60% RH for two months.

Figure 4:
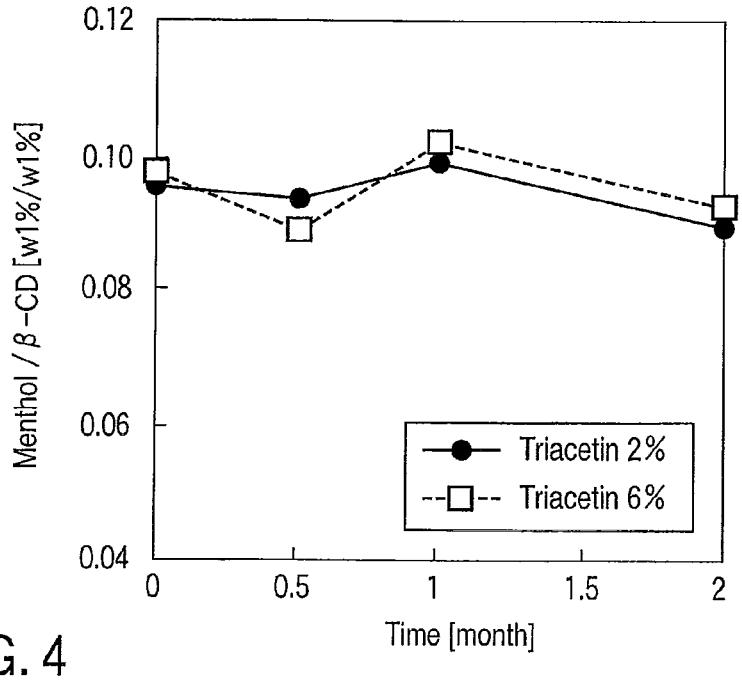
FIG. 4 is a graph showing the evaluation of the change over time in the ratios of the quantified values of β-cyclodextrin and l-menthol.

During the period from the starting of the storage test to two months, the sample was taken out of the container at a predetermined timing. The contents of β-cyclodextrin and l-menthol in the flavor granules collected from the filter were measured by the analysis method as previously mentioned. The change over time in the ratio of the quantified values of β-cyclodextrin and l-menthol obtained from each analysis was evaluated. The results are shown in FIG. 4. In FIG. 4, the group (black circles) and group (□) represent the measurement data for the samples that were prepared by adding triacetin by 2 wt % and 6 wt %, respectively.

It was confirmed from the measurement result that the ratio of the quantified values of β-cyclodextrin and l-menthol was not changed during two months of the storage period. Namely, it was possible to retain l-menthol, which is a volatile flavor component, stably in the filter by β-cyclodextrin, even under conditions including co-existence of charcoal and addition of triacetin that are inherent to cigarettes.

What is claimed is:

1. A cigarette filter comprising: a filter body; and flavor granules added to the filter body, wherein the flavor granules each comprise a spherical granule composed of saccharose and corn starch and a flavor-carrying cyclodextrin adhered to the surface of the spherical granule, and wherein the flavor granules have a grain size distribution such that granules having a grain size of 100 μm or larger make up 99% by mass or more of the flavor granules and granules having a grain size of 200 μm or larger make up 70% by mass or more of the flavor granules.

2. The cigarette filter according to claim 1, wherein the filter has air-flow resistance in a range of 200 to 800 mm Aq/120 mm.

3. The cigarette filter according to claim 1, wherein the flavor granules have an average hardness of 300 g/mm$^2$ or more.

4. The cigarette filter according to claim 1, wherein an amount of the flavor granules added is in a range of 1 to 20 mg per mm of filter length.

5. The cigarette filter according to claim 1, wherein an amount of the cyclodextrin is 1.0 or less by weight ratio with respect to the spherical granule.

6. The cigarette filter according to claim 5, wherein an amount of the cyclodextrin carrier is in a range of 0.001 to 0.5 by weight ratio with respect to the spherical granule.

7. The cigarette filter according to claim 1, wherein an amount of the flavor is in a range of 0.00003 to 0.15 by weight ratio with respect to the spherical granule.

8. The cigarette filter according to claim 1, wherein the flavor is a lipophilic flavor.

9. The cigarette filter according to claim 8, wherein the flavor is menthol.

10. The cigarette filter according to claim 1, wherein the spherical granule has a binder on the surface in addition to the flavor-carrying cyclodextrin.

11. The cigarette filter according to claim 10, wherein the binder is added in a range of 0.001 to 0.1 by weight ratio with respect to the spherical granule.

12. The cigarette filter according to claim 10, wherein the binder is one or more kinds selected from the group consisting of maltose syrup, pullulan, gum arabic and granulated sugar.

* * * * *